United States Patent [19]

Hosokai et al.

[11] Patent Number: 4,457,275

[45] Date of Patent: Jul. 3, 1984

[54] IDLING SPEED CONTROL SYSTEM FOR INTERNAL COMBUSTION ENGINE

[75] Inventors: Tetsushi Hosokai; Hajime Doinaga, Hideo Shiraishi, all of Hiroshima, Japan

[73] Assignee: Toyo Kogyo Co., Ltd., Hiroshima, Japan

[21] Appl. No.: 433,436

[22] Filed: Oct. 8, 1982

[30] Foreign Application Priority Data

Oct. 9, 1981 [JP] Japan ..... 56-161166

[51] Int. Cl.[3] ..... F02D 9/02

[52] U.S. Cl. ..... 123/339; 123/340; 123/349

[58] Field of Search ..... 123/339, 340, 349, 353; 235/150.2; 180/105 E

[56] References Cited

U.S. PATENT DOCUMENTS

| | | | |
|---|---|---|---|
| 4,297,978 | 11/1981 | Matsui | 123/340 |
| 4,344,398 | 8/1982 | Ikeura | 123/339 |
| 4,367,768 | 1/1983 | Nakamura et al. | 123/339 |
| 4,380,979 | 4/1983 | Takase | 123/340 |
| 4,399,789 | 8/1983 | Yano | 123/339 |

FOREIGN PATENT DOCUMENTS

| | | | |
|---|---|---|---|
| 55-98628 | 7/1980 | Japan | 123/339 |

*Primary Examiner*—Raymond A. Nelli

*Attorney, Agent, or Firm*—Gerald J. Ferguson, Jr.; Joseph J. Baker

[57] ABSTRACT

The difference between the actual idling speed of an internal combustion engine and a desired idling speed determined according to the operating conditions of the engine is integrated and the opening angle of the throttle valve is controlled according to the integrated value to control the amount of the intake air, whereby the actual idling speed is equalized to the desired idling speed. When the actual idling speed becomes higher than a predetermined value, the idling speed control is interrupted with said integrating operation being continued and the throttle valve is positively closed.

13 Claims, 6 Drawing Figures

IDLING SPEED CONTROL SYSTEM FOR INTERNAL COMBUSTION ENGINE

BACKGROUND OF THE INVENTION

1. Field of the Invention

This invention relates to an idling speed control system for an internal combustion engine.

2. Description of the Prior Art

In an internal combustion engine of a vehicle, it is generally preferred to maintain the idling speed of the engine at a low value of about 600 to 700 rpm from the viewpoint of fuel consumption. For example, in U.S. Pat. No. 3,661,131 is disclosed a system for maintaining a stabilized idling speed without any possiblity of the engine's stalling in which the actual rotational speed of the engine is detected to carry out a feedback control so that the actual rotational speed during idling is equalized to a desired idling speed.

In order to obtain stability of the control, the feedback control is preferred to be carried out utilizing integral control. (See, U.S. Pat. No. 4,219,000, for example.)

The idling speed is sometimes increased for some reason while the idling speed control is stabilized. For example, when icing occurs around the throttle valve, the amount of the intake air is reduced to lower the idling speed and accordingly the control system successively generates signals for increasing the idling speed. If the icing is meanwhile released in such a state, the amount of the intake air is abruptly increased and the idling speed becomes abnormally high. It is not desirable from the viewpoint of safety and the feeling of the driver that the idling speed dwells in such a high speed zone for a long time.

Thus there has been proposed an idling speed control system having a fail-safe mechanism in which the feedback control of the idling speed is interrupted when the idling speed becomes higher than a predetermined value for some reason and the throttle valve is positively moved in the closing direction. See Japanese Patent Publication No. 53(1978)45861.

However, if the method in which the feedback control of the idling speed is interrupted in the fail-safe manner when the idling speed becomes higher than a predetermined value is simply applied to the idling control system in which the difference between the actual idling speed and a desired idling speed is integrated and an adjusting valve for controlling the amount of the intake air is controlled according to the integrated value to control the idling speed, the integrating function for integrating said difference is interrupted when the idling speed accidentally becomes high and the last integrated value which is the value obtained by integration immediately before the idling speed becomes higher than the predetermined value is held. Therefore hunting in which the rotational speed of the engine goes up and down around the predetermined value continues for a while when the rotational speed returns below the predetermined value and the feedback control is carried out again, and the rotational speed can not be rapidly equalized to the desired idling speed.

SUMMARY OF THE INVENTION

In view of the foregoing observations and description, the primary object of the present invention is to provide an idling speed control system in which the amount of the air to be fed to the engine is positively reduced when the idling speed becomes higher than a predetermined value and at the same time the idling speed can be rapidly equalized to a desired idling speed when the actual idling speed returns below the predetermined value.

In the idling speed control system of the present invention, the difference between the actual idling speed and a desired idling speed is integrated and an adjusting valve for controlling the intake air to be fed to the engine is controlled according to the integrated value to equalize the actual idling speed to the desired value. Said adjusting valve is generally the throttle valve, though may be a bypass valve in case of the system in which the idling speed is controlled by controlling the bypass valve disposed in a bypass passage provided to bypass the throttle valve in the intake system. When the idling speed becomes higher than a predetermined value, the idling control is interrupted with said integrating operation being continued and the adjusting valve is positively moved in the closing direction whereby the control signal for controlling the rotational speed of the engine is always produced taking into account the actual rotational speed of the engine even in the high speed zone. Accordingly, when the actual rotational speed falls below the predetermined value again and the feedback control becomes again necessary, the control signal will control the adjusting valve to still reduce the amount of the intake air, whereby the idling speed is rapidly equalized to the desired idling speed without hunting.

DESCRIPTION OF THE PREFERRED EMBODIMENT

Figure 1:
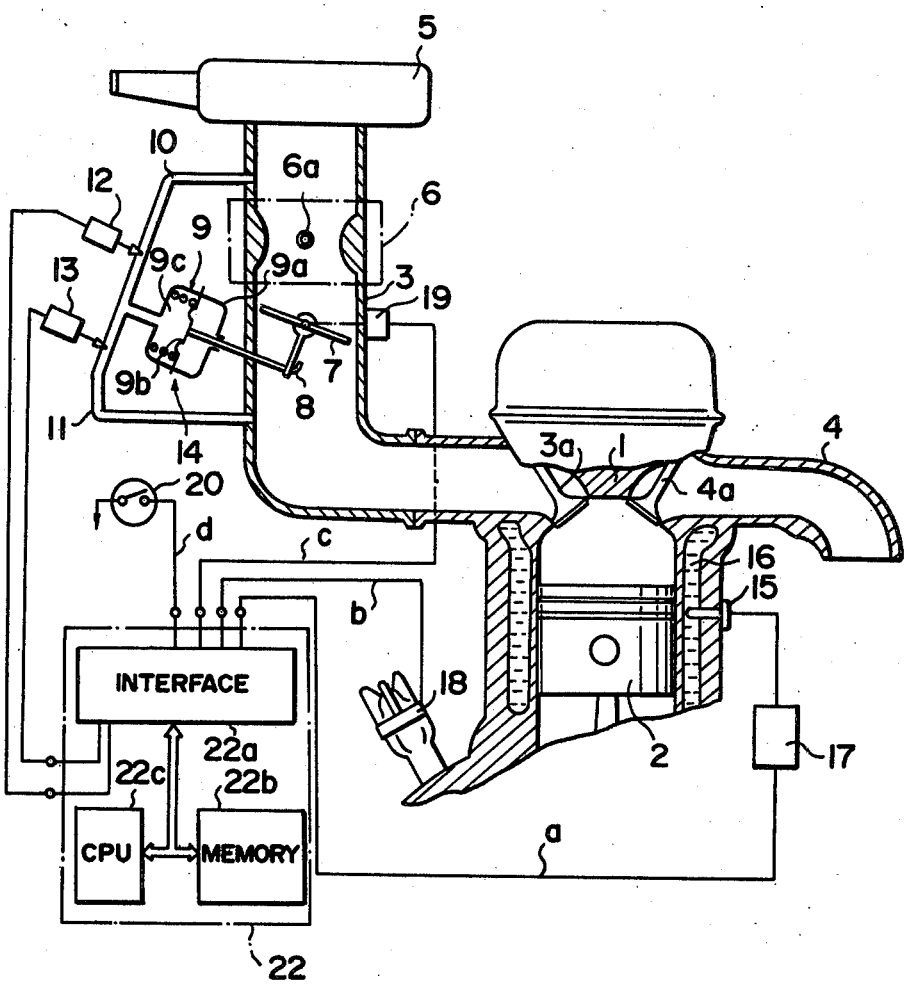
FIG. 1 is a schematic view of an internal combustion engine employing an idling speed controlling system in accordance with an embodiment of the present invention.

In FIG. 1 an internal combustion engine 1 has a piston 2, an intake manifold 3, an intake valve 3*a*, an exhaust manifold 4 and an exhaust valve 4*a*. On the top end of the intake manifold 3 is mounted an air cleaner 5 for filtering the air taken into the intake manifold 3, and a carburettor 6 is provided in the intake manifold 3 below the air cleaner 5. A fuel nozzle 6a of the carburettor 6 opens into the intake manifold 3. A throttle valve 7 is disposed just below or just downstream of the carburettor 6 to control the amount of air fed to the combustion engine 1. The throttle valve 7 is controlled by an actuator 14 including a stopper 8 which is engaged with the throttle valve 7 to open and close it. The stopper 8 is driven by a diaphragm unit 9 comprising a casing 9a and a diaphragm 9b which is mounted in the casing 9a to divide the internal space thereof into two chambers, whereby a vacuum chamber 9c is formed on the side of the diaphragm 9b remote from the stopper 8. The stopper 8 is connected to the diaphragm 9b at its end remote from the throttle valve 7 to move together therewith. A first passage 10 connects the vacuum chamber 9c to the space in the intake manifold 3 upstream of the throttle valve 7 which is substantially at atmospheric pressure, while a second passage 11 connects the vacuum chamber 9c to the space in the induction manifold 3 downstream of the throttle valve 7 which is at a negative pressure. First and second solenoid valves 12 and 13 are provided to open and close the respective passages 12 and 13.

A water temperature sensor 15 detects the temperature of cooling water 16. The output of the sensor 15 is inputted into an A/D converter 17 which converts the analogue signal output of the sensor 16 into a digital signal. The output of the A/D converter 17, or a water temperature signal a is inputted into an interface 22a of an actuator controlling device 22 which will be described hereinbelow. A distributor 18 contains therein a rotational speed detector (an electromagnetic pick-up device) for detecting the rotational speed of the combustion engine 1 the output of which is inputted into the interface 22a of the actuator controlling device 22 as a rotational speed signal b. A throttle position sensor 19 detects the opening angle of the throttle valve 7 and delivers a throttle opening angle signal c to the interface 22a. A cooler load signal d which is the output of a cooler switch 20 is further inputted into the interface 22a.

The actuator controlling device 22 is in the form of a microcomputer comprising the interface 22a, a memory 22b and a CPU (Central Processing Unit) 22c, and compares the actual idling speed detected by the rotational speed detector with a desired idling speed which is determined according to the operating conditions of the engine 1 to determine a target opening angle of the throttle valve 7 according to the difference therebetween. At the same time, the actuator controlling device 22 compares the actual opening angle of the throttle valve 7 detected by the throttle position sensor 19 with the target opening angle of the valve 7 and controls the actuator 14 according to the difference therebetween so that the actual idling speed is equalized to the desired idling speed.

Figure 2:
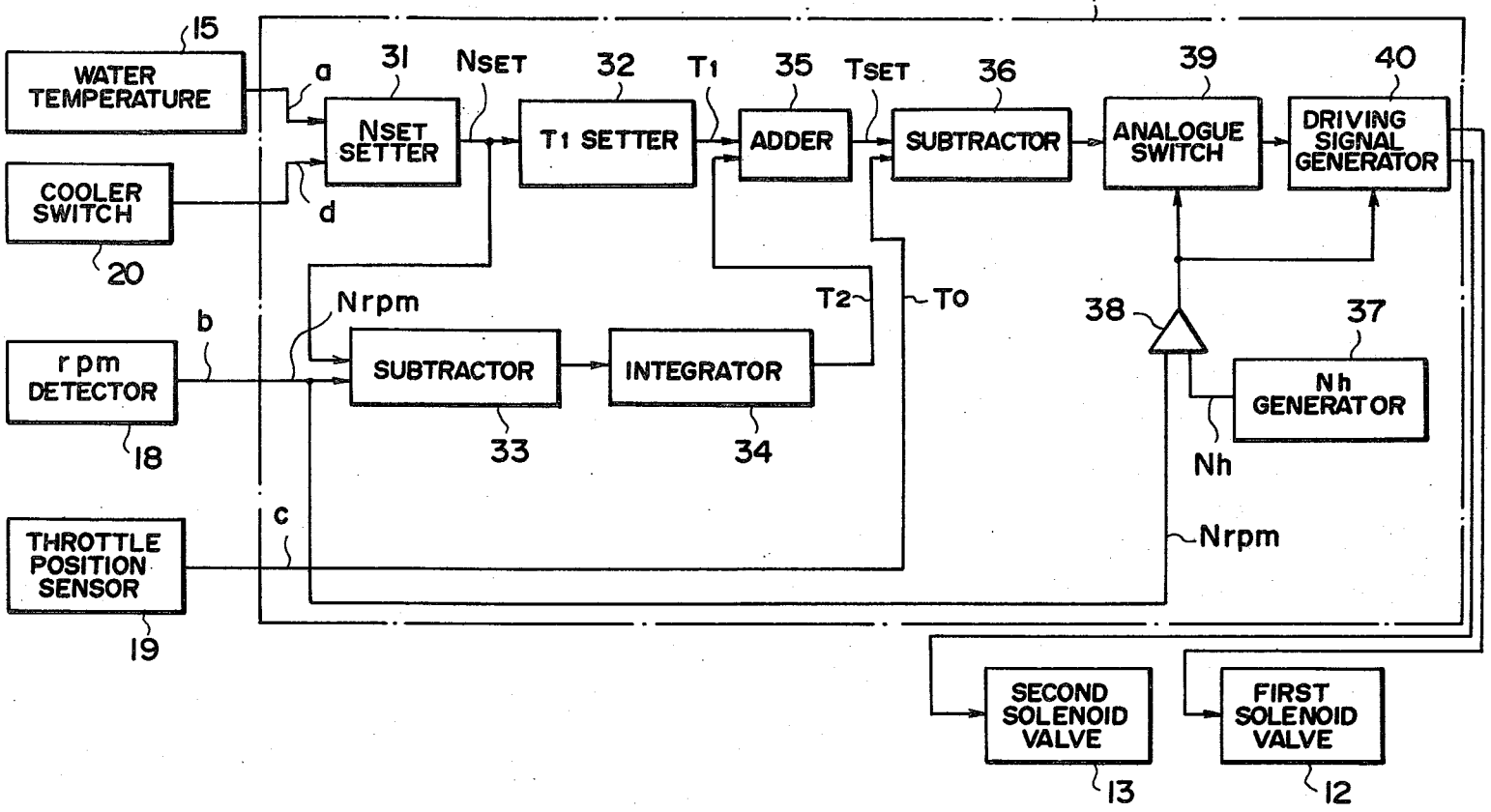
FIG. 2 is a block diagram of an example of an actuator controlling device which can be used in the idling speed controlling system of FIG. 1, FIG. 3(*a*) is a graph showing the relationship between the temperature of the cooling water and the desired idling speed in case of the embodiment of FIG. 1, FIG. 3(*b*) is a graph showing the relationship between the temporary target opening angle of the throttle valve and the desired idling speed, FIG. 3(*c*) is a graph showing the relationship between the duty ratio of the solenoid valve driving signal and the difference between the target opening angle of the throttle valve and the actual opening angle of the same.

FIG. 2 is a block diagram of an example of the actuator controlling device. In FIG. 2, like parts and like signals bear the same reference numerals or symbols as those in FIG. 1. In FIG. 2 the part surrounded by the chained line corresponds to the microcomputer in FIG. 1 as indicated at 22. A desired idling speed setter 31 determines a desired idling speed Nset according to the water temperature signal a and the cooler load signal d in accordance with the relationship shown in FIG. 3(*a*). A temporary target throttle angle setter 32 determines a temporary target opening angle T1 of the throttle valve 7 according to the desired idling speed Nset in accordance with the relationship shown in FIG. 3(*b*). The difference between the desired idling speed Nset and the actual rotational speed Nrpm of the engine 1 detected by the rotational speed detector 18 is calculated by a first subtractor 33. An integrator 34 integrates the output of the subtractor 33 to obtain a correction term T2 for a target opening angle Tset of the throttle valve 7. An adder 35 adds the correction term T2 to the temporary target opening angle T1 to obtain the target opening angle Tset of the throttle valve 7. A second subtractor 36 calculates the difference between the actual opening angle T0 of the throttle valve 7 detected by the throttle position sensor 19 and the target opening angle Tset of the same. A predetermined rotational speed generator 37 generates an electric voltage corresponding to a predeterined value Nh of the rotational speed of the engine 1 above which the idling speed control is interrupted. A comparator 38 compares the actual rotational speed Nrpm of the engine with the predetermined value Nh and outputs "1" when the former is smaller than the latter. An analogue switch 39 transmits the output [Tset-T0] of the second subtractor 36 to a driving signal generator 40 when the output of the comparator 38 is "1", and prevents the output [Tset-T0] from being transmitted to the generator 40 when the output of the comparator 38 is "0". The driving signal generator 40 generates a pulse signal having a desired duty ratio for driving the solenoid valve 12 or 13 in accordance with the relationship shown in FIG. 3(*c*) according to the output of the second subtractor 36 when receiving it. Further, the driving signal generator 40 generates another driving signal for positively closing the first solenoid valve 12 to move the throttle valve 7 in the closing direction when "0" output of the comparator 38 is inputted thereto.

Now, operation of the control system of FIG. 1 will be described referring to FIG. 4 which slows a flow chart of operation of the CPU 22c.

In step S1, the CPU 22c determines whether or not the engine is idling by way of the throttle opening angle signal c and the rotational speed signal b. The CPU 22c determines that the engine is idling when the throttle valve 7 is in the idling position and at the same time the rotational speed of the engine is lower than the predetermined value Nh. If NO, i.e., if it is determined that the engine is not idling, the CPU 22c repeats the step S1 until the result becomes YES. If YES, i.e., if it is determined that the engine is idling, the CPU 22c proceeds to step S2.

In the step S2, the CPU 22c determines the operating condition of the engine 1 based on the water temperature signal a representing the temperature of the cooling water and the cooler load signal d representing whether or not the cooler is in operation. In step S3, the desired idling speed Nset is calculated according to the determined operating condition of the engine in accordance with the relationship shown in FIG. 3(*a*). As can be seen from FIG. 3(*a*), when the temperature of the cooling water is low, the desired idling speed Nset is set at a high value. This is because when the ambient temperature is low, idling cannot be stabilized unless the rotational speed of the engine is higher than a certain value. When the cooler is in operation, the desired idling speed is set at a value higher than when the cooler is not in operation in order to assure the efficiency of the cooler, to reduce vibration of the engine and to assure that the dynamo can generate sufficient electric current to operate the cooler.

Figure 3A:
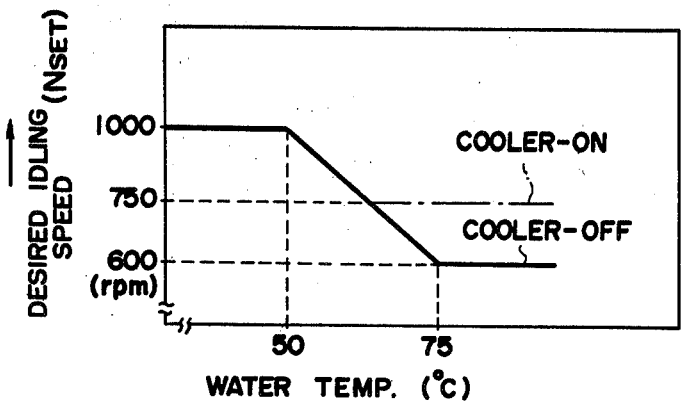
Figure 3B:
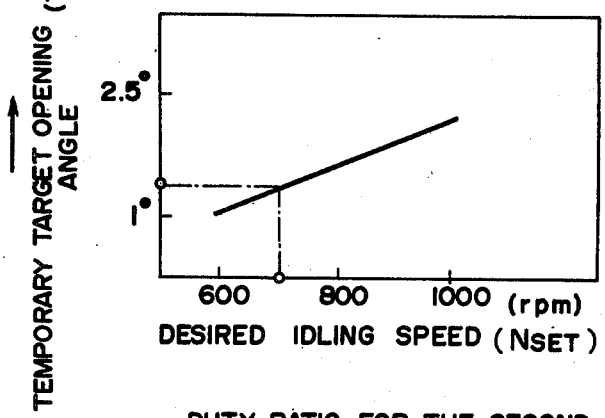
Figure 3C:
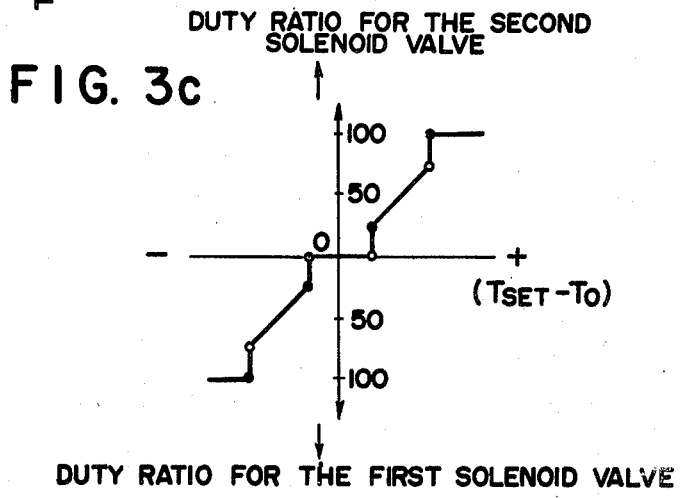

In the next step S4, the temporary target opening angle T1 of the throttle valve 7 corresponding to the desired idling speed Nset is obtained in accordance with the relationship shown in FIG. 3(*b*). Then in step 5, the actual rotational speed Nrpm of the engine is detected through the rotational speed signal b. Thereafter, in step S6, the difference between the desired idling speed Nset and the actual rotational speed Nrpm is multiplied by a constant k to obtain the correction term T2 for the target opening angle Tset of the throttle valve 7, i.e., T2=k (Nset-Nrpm). When the CPU 22*c* repeats the entire flow chart of FIG. 4, the previous correction term is added to the newly obtained correction term. Thus, in this case, the sum T2′ of the newly obtained correction term T2 and the previous correction term is used as the correction term. In step S7, the correction term T2 or T2′ is added to the temporary target opening angle T1 to obtain the target opening angle Tset. In step S8, the actual opening angle T0 is detected by way of the throttle valve opening angle signal c. In step S9, it is determined whether or not the actual rotational speed Nrpm is larger than the predetermined value Nh. If NO, the difference between the temporary target opening angle Tset and the actual opening angle T0 is calculated and a pulse signal having a duty ratio which is determined in accordance with the relationship shown in FIG. 3(*c*) according to the different is outputted as the driving signal for the solenoid valves 12 and 13 in step S10. If YES, the signal for positively opening the first solenoid valve 12 to close the throttle valve 7 is outputted in step S11.

Figure 4:
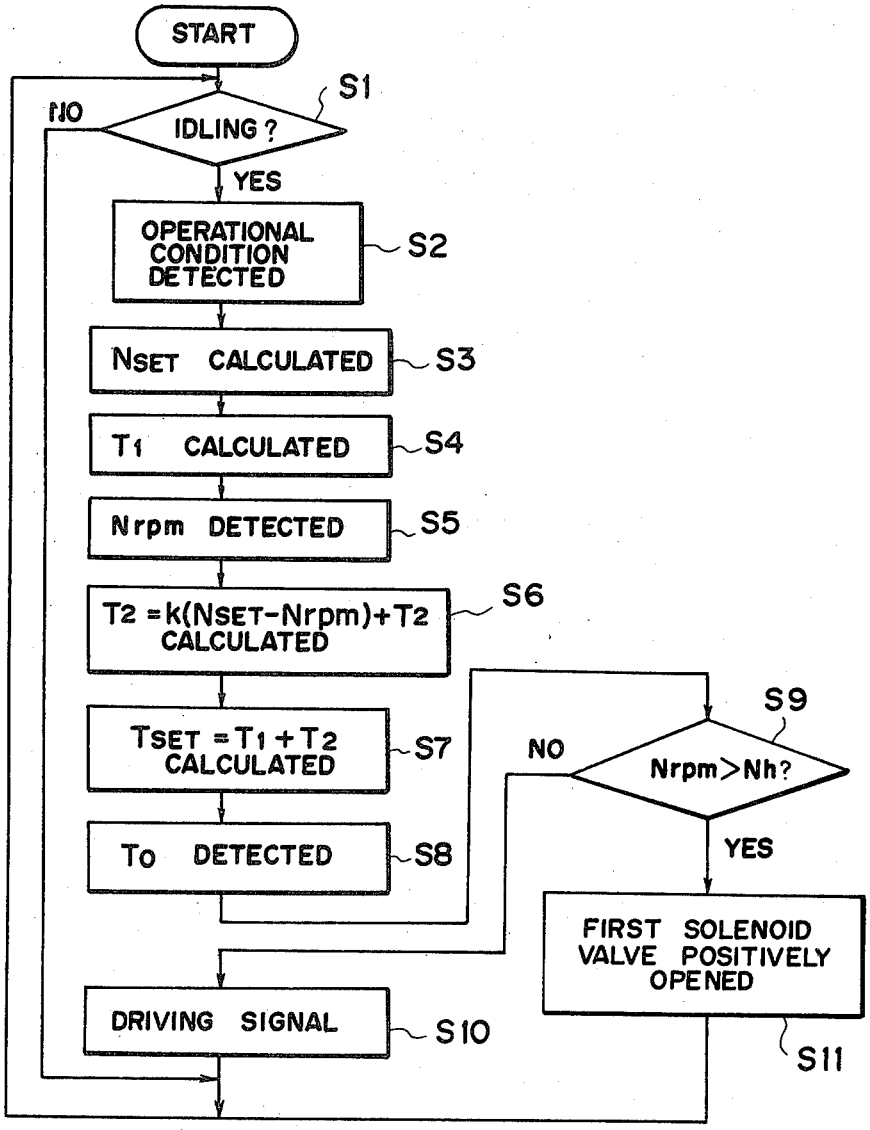
FIG. 4 is a flow chart of the CPU employed in the idling controlling system of FIG. 1, FIGS. 5(*a*) to 5(*d*) are views for illustrating the operation of the system of FIG. 1 assuming, by way of example, that the rotational speed of the engine changes as shown in FIG. 5(*a*)

Generally the CPU 22*c* repeats the entire processing shown in FIG. 4 at rate of once in about 30 msec.

Figure 5:
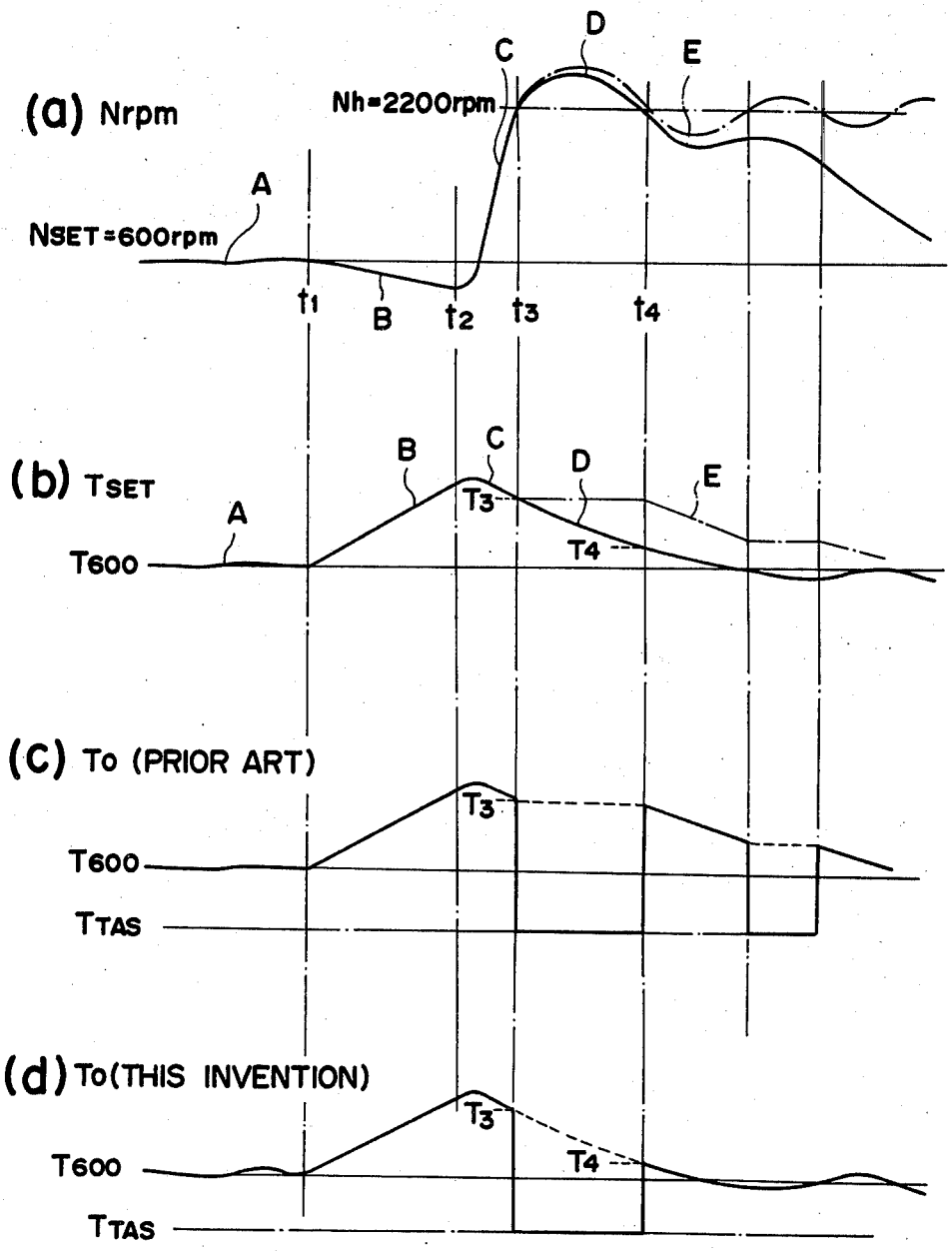

Now the operation of the idling speed control system of this embodiment will be described assuming, by way of example, that the rotational speed of the engine changes as shown in FIG. 5(*a*).

FIG. 5(*a*) shows that the rotational speed of the engine which was near a desired idling speed Nset (600 rpm in this particular example) as shown in region A once slightly falled at time t1 for some reason (e.g., icing) as shown in region B and then abruptly increased at time t2 as shown in region C to a value higher than a predetermined value Nh (2200 rpm in this particular embodiment) at time t3 as shown in region D. FIG. 5(*a*) further shows that the rotational speed can be rapidly equalized to the desired idling speed Nset=600 rpm in accordance with the present invention as shown by the solid line in region E while in accordance with the prior art system hunting of the rotational speed will occur as shown by the chained line in region E. FIG. 5(*b*) shows the change of the target opening angle of the throttle valve when the actual rotational speed changes as shown in FIG. 5(*a*), wherein the solid line in regions (D) and (E) corresponds to the present and the chained line in regions (D) and (E) corresponds to the prior art system. FIG. 5(*c*) shows the change of the actual opening angle of the throttle valve in case of the prior art system while FIG. 5(*d*) shows the change of the actual opening angle of the throttle valve in case of the system of the present invention. Said prior art system is those in which the idling speed control is completely interrupted when the rotational speed Nrpm of the engine becomes higher than the predetermined value Nh (2200 rpm), i.e., the calculation of the target opening angle Nset of the throttle valve is interrupted as well as the control of the actuator.

As shown in FIGS. 5(*b*) to 5(*c*), while the rotational speed Nrpm of the engine is below the predetermined value Nh (2200 rpm), in accordance with either the system of the present invention or the prior art system, the actual opening angle T0 of the throttle valve changes following the change of the target opening angle Tset of the throttle valve. Namely, when the actual rotational speed Nrpm is near the desired idling speed 600 rpm, both the target opening angle Tset and the actual opening angle T0 are at T600 corresponding to the desired idling speed 600 rpm as shown in region A, when the actual rotational speed Nrpm falls as shown in region B, both the target opening angle Tset and the actual opening angle T0 are increased, and when the actual rotational speed Nrpm increases as shown in region C, both the target opening angle Tset and the actual opening angle T0 are reduced. On the other hand, when the acutal rotational speed Nrpm becomes higher than the predetermined value Nh=2200 rpm at time t3, in case of the prior art system the target opening angle Tset of the throttle valve is kept constant at T3 in region D as shown by the chained line while the actual opening angle T0 is momentarily reduced to the TAS opening angle $T_{TAS}$ at the time t3 since the feedback control is completely interrupted. Thereafter, when the rotational speed Nrpm falls below the predetermined value Nh=2200 rpm at time t4, the feedback control is again carried out and the target opening angle Tset is gradually reduced from the T3 in region E as shown by the chained line, while the actual opening angle T0 momentarily returns to the T3 at the time t4 and then is gradually reduced following the target opening angle Tset. However since the target opening angle Tset has been kept at the high opening angle T3, the actual opening angle T0 of the throttle valve takes a high value in region E, and accordingly the actual rotational speed Nrpm is not so lowered but conversely increased above the predetermined value Nh in region E. Such action is repeated several times, i.e., the so-called hunting occurs.

On the other hand, in case of the system of the present invention, although in the region D in which the rotational speed Nrpm of the engine becomes higher than the predetermined value Nh the opening angle T0 of the throttle valve is immediately reduced to the TAS opening angle $T_{TAS}$ by the actuator, the calculation of the target opening angle Tset is continued. Therefore, the target opening angle Tset is gradually reduced even in the region D, and takes a relatively low value T4 at the time t4. Therefore, the actual opening angle T0 is increased only to a relativey low value T4 so that the rotational speed Nrpm of the engine is not increased above the predetermined value Nh. Thus in case of the present invention, the rotational speed Nrpm of the engine is rapidly equalized to the desired idling speed Nset without hunting.

The operation of the actuator controlling device shown in FIG. 2 is substantially the same as the operation of the microcomputer described above. Therefore, it will not be described in detail.

Further, in the above embodiment the integrated value of the deviation of the actual rotational speed from the desired idling speed is reflected in the deviation of the actual opening angle of the throttle from the target opening angle and the feedback control is carried out to equalize the actual opening angle to the target opening angle. However, the present invention can also be applied to a system in which feedback control is not carried out with respect to the opening angle of the throttle valve and feedback control is carried out with respect only to the rotational speed of the engine.

Further in the above embodiment, the idling speed is controlled by controlling the opening angle of the throttle valve. However, the present invention can be applied to a system in which the idling speed is controlled by controlling the flow of air through a bypass passage bypassing the throttle valve.

Figure 6:
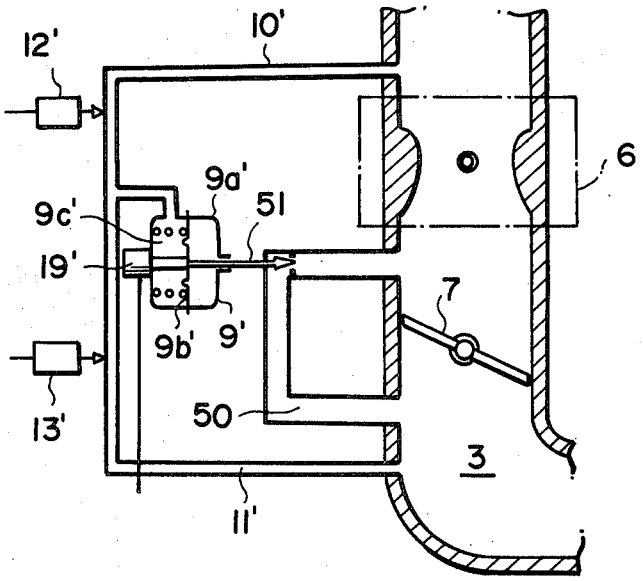
FIG. 6 is a schematic view showing a part of an idling speed controlling system in accordance with another embodiment of the present invention.

In FIG. 6, a bypass passage 50 is provided so that one end thereof opens into the intake manifold 3 between the caburretor 6 and the throttle valve 7, and the other end thereof opens into the intake namifold 3 downstream of the throttle valve 7. A bypass valve 51 is provided in the bypass passage 50 to open and close the bypass passage 50 to control the amount of the air flowing therethrough. The bypass valve 51 is controlled by a diaphragm device 9' which is substantially the same as the diaphragm device 9 in FIG. 1 in its structure and includes a casing *9a'*, diaphragm *9b'* and a vacuum chamber *9c'*. A first passage 10' connects the vacuum chamber *9c'* to the space upstream of the caburretor 6 in the intake manifold 3, while a second passage 11' connects the vacuum chamber *9c'* to the space downstream of the throttle valve 7 in the induction manifold 3. First and second solenoid valves 12' and 13' are provided to open and close the first and second passages 10' and 11', respectively. Further, a position sensor 19' is provided to detect the position of the bypass valve 51. This system can be controlled in a manner identical to that of the system of FIG. 1 and the signals taken out from or fed to the position sensor 19' and solenoid valves 12' and 13' may be identical to those taken out from or fed to the position sensor 19 and solenoid valves 12 and 13 in FIG. 1, respectively.

We claim:

1. An idling speed control system for an internal combustion engine having an intake system a throttle valve disposed therein and an exhaust system, comprising a rotational speed detecting means for detecting the rotational speed of the engine and outputting a rotational speed signal, an actuator means for driving an adjusting valve for controlling the amount of the intake air to be fed to the engine to control the rotational speed of the engine during idling, and a control circuit which receives the rotational speed signal and includes a comparing means which compares the actual rotational speed of the engine and a desired idling speed determined according to the operating conditions of the engine and outputs the difference therebetween; an integrating means which integrates the output of the comparing means and outputs the integrated value; and a driving signal generating means which when the actual rotational speed of the engine is not higher than a predetermined value which is higher than the desired idling speed, receives the output of the integrating means and outputs a first driving signal according thereto for controlling the adjusting valve so that the difference between the actual rotational speed and the desired idling speed is nullified, while when the actual rotational speed of the engine becomes higher than the predetermined value, inhibits the input of the output of the integrating means and outputs a second driving signal for positively closing the adjusting valve, said integrating means continuously outputting the integrated value irrespective of whether or not the actual rotational speed is higher than the predetermined value.

2. An idling speed control system as defined in claim 1 further comprising a valve position detecting means for generating a valve position signal representing the actual position of said adjusting valve, wherein said driving signal generating means includes a target valve position setting means for generating a target valve position signal which represents a target position of the adjusting valve during idling according to the output of the integrating means; a valve position comparing means which compares the actual position of the adjusting valve detected by the valve position detecting means and the target position thereof determined by the target valve position setting means, and outputs the result of the comparison; and a signal outputting means which receives the output of the valve position comparing means and outputs said first driving signal in the form of a signal which equalizes the actual position of the adjusting valve to the target position of the same, thereby nullifying the difference between said actual rotational speed and the desired idling speed.

3. An idling speed control system as defined in claim 2 in which said target valve position setting means includes a desired valve position setting means which outputs a desired valve position signal representing a desired position of the adjusting valve which is preset to obtain said desired idling speed, and an adder which adds the desired valve position signal to the output of said integrating means to output said target valve position signal.

4. An idling speed control system as defined in claim 3 in which said adjusting valve is said throttle valve.

5. An idling speed controlling system as defined in claim 4 in which said actuator means includes a stopper which engages with the throttle valve to open and close it, the throttle valve being urged to close the intake system and the minimum opening degree of the throttle valve being defined by the stopper, a diaphragm device having a diaphragm and a pressure chamber defined by the diaphragm, said stopper being connected to the diaphragm to be moved together with the diaphragm according to the pressure in the pressure chamber, and a solenoid valve which controls the pressure in the pressure chamber of the diaphragm device under control of said driving signals.

6. An idling speed controlling system as defined in claim 3 in which said adjusting valve is a bypass valve disposed in a bypass passage provided to bypass the throttle valve in the intake system.

7. An idling speed controlling system as defined in claim 6 in which said actuator means includes a connecting member which is connected with the bypass valve to open and close it, a diaphragm device having a diaphragm and a pressure chamber defined by the diaphragm, said connecting member being connected to the diaphragm to be moved together with the diaphragm according to the pressure in the pressure chamber, and a solenoid valve which controls the pressure in the pressure chamber of the diaphragm device under control of said driving signals.

8. An idling speed control system for an internal combustion engine having an intake system, a throttle valve disposed therein and an exhaust system, comprising a rotational speed detecting means for detecting the rotational speed of the engine and outputting a rotational speed signal, a valve position detecting means for detecting the position of an adjusting valve for controlling the amount of the intake air to be fed to the engine and for outputting the valve position signal, an actuator means for driving the adjusting valve to control the rotational speed of the engine during idling, and a control circuit including a first comparing means which compares the actual rotational speed of the engine detected by the rotational speed detecting means with a desired idling speed determined according to the operating conditions of the engine and outputs the result of the comparison; an integrating means which integrates the output of the first comparing means and outputs the integrated value; a target valve positon setting means which receives the output of the integrating means and outputs a target value position signal representing a target position of the adjusting valve during idling which is determined based on at least the output of the integrating means; a second comparing means which compares the actual position of the adjusting valve represented by the valve position signal with the target position of the same represented by the target value position signal and outputs the result of the comparison; and a driving signal generating means which when the actual rotational speed of the engine is not higher than a predetermined value which is higher than the desired idling speed, receives the output of the second comparing means and outputs a first driving signal according thereto for controlling the adjusting valve so that the difference between the actual rotational speed and the desired idling speed is nullified, while when the actual rotational speed becomes higher than the predetermined value, inhibits the input of the output of the second comparing means and outputs a second driving signal for positively closing the adjusting valve, said target valve position setting means continuously outputting said target valve position signal irrespective of whether or not the actual rotational speed of the engine is higher than the predetermined value.

9. An idling speed control system as defined in claim 8 in which said target valve position setting means includes a desired valve position setting means which outputs a desired valve position signal representing a desired position of the adjusting valve which is preset to obtain said desired idling speed, and an adder which adds the desired valve position signal to the output of said integrating means to output said target valve position signal.

10. An idling speed control system as defined in claim 9 in which said adjusting valve is said throttle valve.

11. An idling speed controlling system as defined in claim 10 in which said actuator means includes a stopper which engages with the throttle valve to open and close it, the throttle valve being urged to close the intake system and the minimum opening degree of the throttle valve being defined by the stopper, a diaphragm device having a diaphragm and a pressure chamber defined by the diaphragm, said stopper being connected to the diaphragm to be moved together with the diaphragm according to the pressure in the pressure chamber, and a solenoid valve which controls the pressure in the pressure chamber of the diaphragm device under control of said driving signals.

12. An idling speed controlling system as defined in claim 9 in which said adjusting valve is a bypass valve diposed in a bypass passage provided to bypass the throttle valve in the intake system.

13. An idling speed controlling system as defined in claim 12 in which said actuator means includes a connecting member which is connected with the bypass valve to open and close it, a diaphragm device having a diaphragm and a pressure chamber defined by the diaphragm, said connecting member being connected to the diaphragm to be moved together with the diaphragm according to the pressure in the pressure chamber, and a solenoid valve which controls the pressure in the pressure chamber of the diaphragm device under control of said driving signals.

* * * * *